US006802756B2

(12) United States Patent
Zimmerman

(10) Patent No.: US 6,802,756 B2
(45) Date of Patent: Oct. 12, 2004

(54) DIAPHRAGM WATER GUN

(76) Inventor: Jeffrey C Zimmerman, 568 Saratoga Rd., King of Prussia, PA (US) 19406

( * ) Notice: Subject to any disclaimer, the term of this patent is extended or adjusted under 35 U.S.C. 154(b) by 0 days.

(21) Appl. No.: 10/454,091

(22) Filed: Jun. 4, 2003

(65) Prior Publication Data

US 2004/0077266 A1 Apr. 22, 2004

Related U.S. Application Data

(60) Provisional application No. 60/385,870, filed on Jun. 5, 2002.

(51) Int. Cl.[7] ..... A63H 29/10; A63H 33/40

(52) U.S. Cl. ..... 446/176; 446/180; 446/197; 446/475; 222/79

(58) Field of Search ..... 446/176, 180, 446/186, 197, 475; 222/39, 79

(56) References Cited

U.S. PATENT DOCUMENTS

| | | | | |
|---|---|---|---|---|
| 3,333,600 A | | 8/1967 | Mercier | |
| 4,135,559 A | | 1/1979 | Barnby | |
| 4,556,093 A | | 12/1985 | Jones | |
| 4,615,488 A | | 10/1986 | Sands | |
| 5,238,149 A | * | 8/1993 | Johnson et al. | 222/79 |
| 5,373,833 A | | 12/1994 | D'Andrade | |
| RE35,412 E | | 12/1996 | Johnson et al. | |
| 5,695,120 A | | 12/1997 | Kingsford | |
| 5,758,800 A | | 6/1998 | D'Andrade | |
| 5,799,827 A | | 9/1998 | D'Andrade | |
| 5,865,344 A | | 2/1999 | Nagel | |
| 5,875,927 A | | 3/1999 | D'Andrade | |
| 5,878,914 A | | 3/1999 | Johnson | |
| 6,012,609 A | | 1/2000 | D'Andrade | |
| 6,123,229 A | | 9/2000 | Barish | |
| 6,158,619 A | | 12/2000 | D'Andrade et al. | |
| 6,167,925 B1 | | 1/2001 | D'Andrade et al. | |
| 6,193,107 B1 | | 2/2001 | D'Andrade | |
| 6,345,732 B1 | | 2/2002 | Zimmerman et al. | |
| 6,364,219 B1 | | 4/2002 | Zimmerman et al. | |

OTHER PUBLICATIONS

International Search Report for PCT/US03/17491; Dated Oct. 20, 2003.

* cited by examiner

*Primary Examiner*—Derris H. Banks
*Assistant Examiner*—Ali Abdelwahed
(74) *Attorney, Agent, or Firm*—Volpe and Koenig, P.C.

(57) ABSTRACT

A diaphragm actuated toy water gun is provided which includes a housing having a handle with a trigger as well as a barrel with a water ejection nozzle located thereon. A water supply tank is connected to the main housing which can be filled with water. A pump is located on the housing for pumping water from the supply tank to at least one diaphragm chamber located on the housing. The diaphragm chamber is formed between a fixed wall and a flexible diaphragm, which can be deflected and expanded from its neutral position into a diaphragm housing. A release valve C the diaphragm assembly. Actuation of the release valve allows a stream of water to be ejected from the diaphragm water gun.

14 Claims, 3 Drawing Sheets

FIG. 3
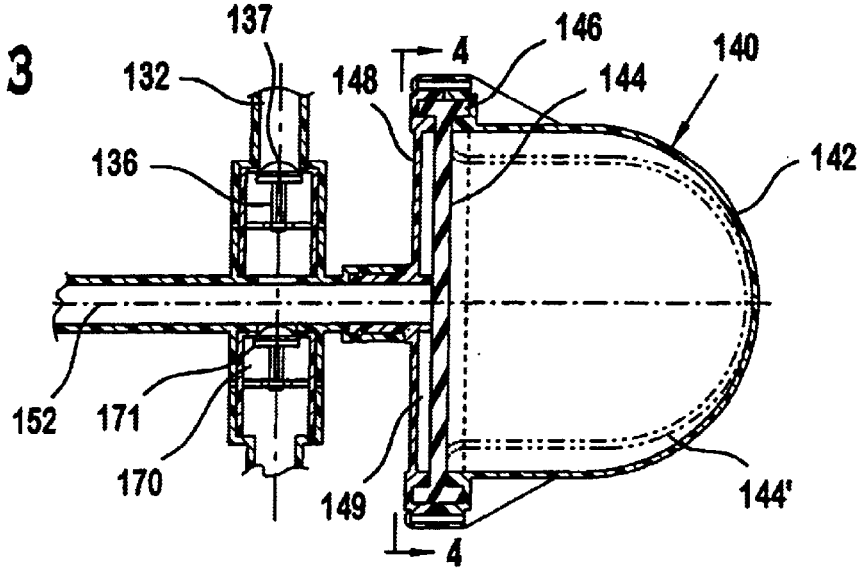
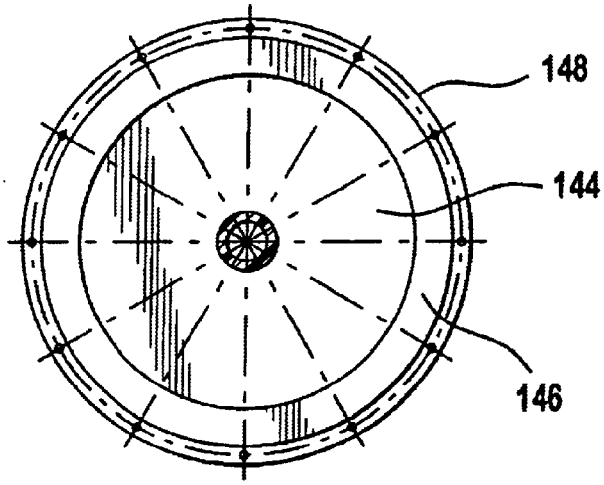
FIG. 4
FIG. 5
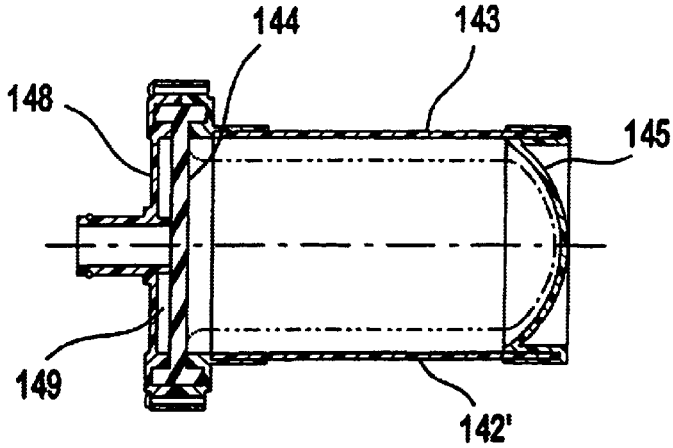

DIAPHRAGM WATER GUN

CROSS-REFERENCE TO RELATED APPLICATION

This application claims the benefit of U.S. Provisional Application No. 60/385,870, filed Jun. 5, 2002, which is incorporated by reference as if fully set forth.

BACKGROUND

The present invention is directed to a diaphragm water gun and more particularly, to a water gun having a diaphragm membrane which is displaced and expanded into a housing in order to pressurize water for release from the water gun.

Toy water guns are known which utilize pressurized air or a pressurized bladder as the motive force for discharging water from the gun upon release of a nozzle valve. U.S. Pat. No. 4,135,559 describes a water toy and fill valve combination. The water toy includes a resiliently expandable tubular bladder which serves as the pressurized water reservoir and the motive member for discharging water from the gun. Pressurized water is loaded into the bladder via the fill valve combination such that the bladder expands due to water pressure of the water from the fill valve. A trigger is provided which is connected to a release valve is provided for allowing water to be ejected from the toy water gun.

U.S. Pat. No. 5,799,827 discloses a similar water gun having a tubular bladder arranged in a tubular holding member. A separate water tank is located on the gun which holds water at ambient pressure. A pump located on the gun is utilized to transfer water from the ambient pressure water tank into the bladder, expanding the bladder. Upon release of a nozzle valve, water is ejected from the toy gun.

U.S. Pat. No. 5,878,914 discloses a similar toy water gun utilizing a water tank with water at ambient pressure, a pump and a balloon-shaped bladder located in a bladder chamber. Specialized valving means are provided to restrict air in the water reservoir from being pumped into the bladder. An alternate type of pressure chamber is also described in which the pressure chamber is formed by a spring-loaded wall which can be compressed within a chamber.

A drawback with these types of arrangements is that it is difficult and costly to produce a tubular or balloon-shaped bladder economically and with the desired characteristics to provide for fluid discharge with a relatively constant pressure during the entire discharge operation. Additionally, such arrangements always leave some amount of water trapped within the bladder in its unexpanded configuration.

SUMMARY

Briefly stated, the present invention provides a diaphragm toy water gun. The water gun includes a housing having a handle with a trigger as well as a barrel with a water ejection nozzle located thereon. A water supply tank is connected to the main housing which can be filled with water. A pump is located on the housing for pumping water from the supply tank to at least one diaphragm chamber located on the housing. The diaphragm chamber is formed between a fixed wall and a flexible diaphragm, which can be deflected and expanded from its neutral position into a diaphragm housing. A release valve is in fluid communication with the diaphragm assembly. Actuation of the release valve allows a stream of water to be ejected from the diaphragm water gun.

In another aspect of the invention, two or more diaphragm assemblies, each having a separate diaphragm and diaphragm housing are located on the water gun housing to provide a greater capacity for holding pressurized water.

In another aspect of the invention, a disk valve is located between the diaphragm chamber and the water ejection nozzle. The disk valve is pivotable about an axis parallel to the direction of flow and can be opened relatively quickly using a simple actuator mechanism that can be produced in a cost effective manner.

BRIEF DESCRIPTION OF THE DRAWING(S)

The foregoing summary, as well as the following detailed description of the preferred embodiment of the present invention will be better understood when read in conjunction with the appended drawings. For the purposes of illustrating the invention, there is shown in the drawings an embodiment which is currently preferred. It should be understood, however, that the invention is not limited to the precise arrangement shown.

FIG. 3 is a side elevational view, partially in cross-section, showing the arrangement of a single diaphragm which can be used in a diaphragm water gun in accordance with the present invention.

FIG. 4 is a left-side elevational view of the diaphragm mounted in the diaphragm housing shown in FIG. 3.

FIG. 5 is a side elevational view of an alternate embodiment of the diaphragm housing in accordance with the present invention.

DETAILED DESCRIPTION OF THE PREFERRED EMBODIMENT(S)

Figure 1:
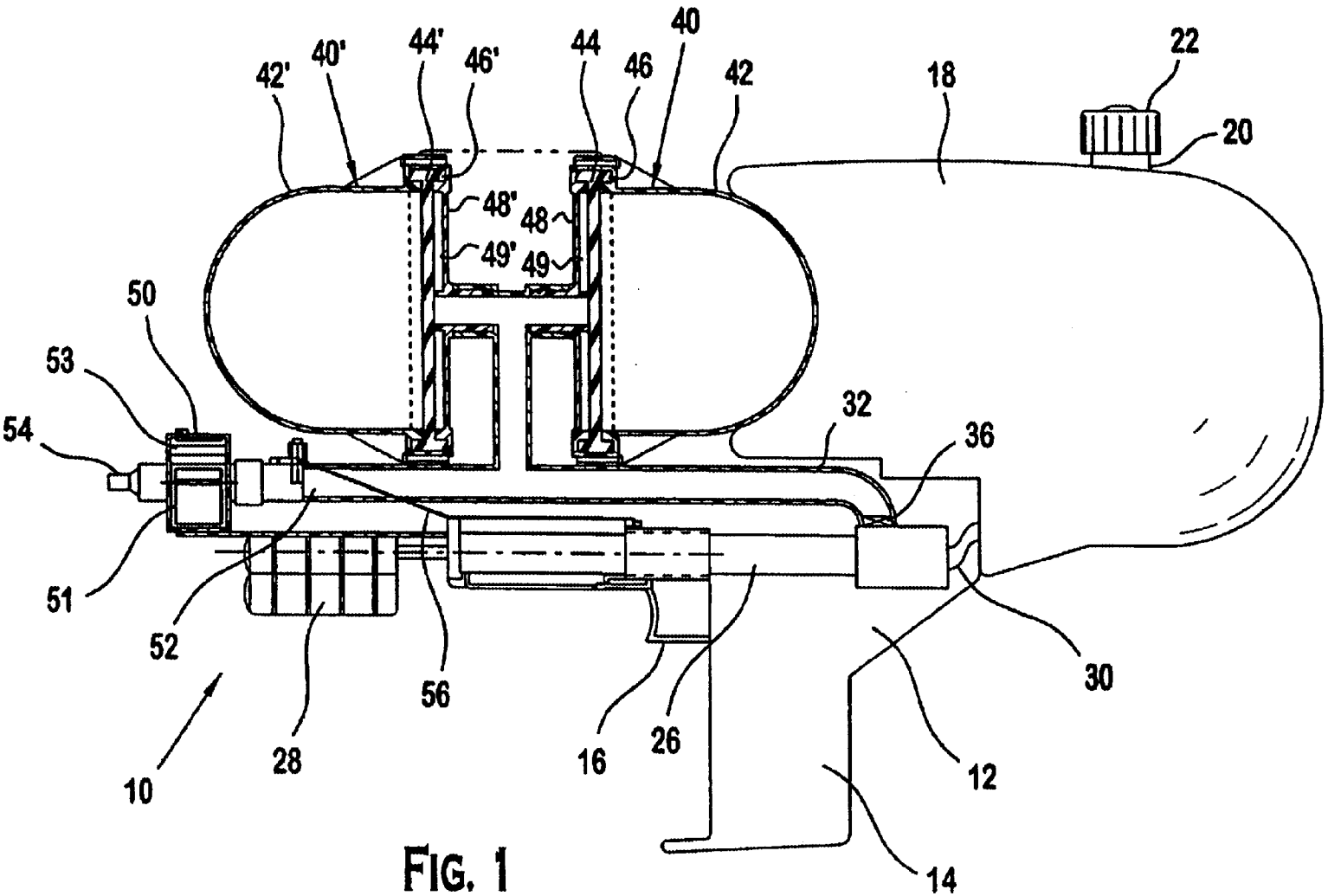
FIG. 1 is a side elevational view, partially in cross-section, of a diaphragm water gun in accordance with the present invention.

Referring now to FIG. 1, the diaphragm water gun 10 in accordance with the present invention is shown. The water gun 10 includes a housing, generally indicated as 12, having a handle 14 located thereon. A trigger 16 is located adjacent to the handle 14. A water supply tank 18 having an inlet 20 which can be filled with water at ambient pressure is connected to the housing. A screw-on cap 22 is preferably provided on the supply tank 18. A pump 26 is connected to the housing and includes a pump handle 28 which can be moved back-and-forth in order to draw water from the supply tank 18 via a conduit 30 into the pump 26 and forces water out of the pump 26 via a conduit 32 toward at least one diaphragm assembly 40, 40'. Preferably, a check valve 36 is located along the conduit 32 such that water cannot be forced backward from the diaphragm assemblies 40, 40' back through the pump 26 and into the tank 18.

Each diaphragm assembly 40, 40' includes a diaphragm housing 42, 42' having a diaphragm 44, 44' clamped across an open end thereof. The diaphragm 44, 44' is preferably circular and has an enlarged bead 46 around the circumferential periphery. This bead 46 assists in clamping. Preferably, the diaphragm 44, 44' is made of an elastic or rubberized material, or any other suitable natural or synthetic rubber, which allows the diaphragm 44, 44' to expand into the diaphragm housing 42, 42'. A cover plate 48, 48' is used to hold the diaphragm in position and forms a wall of the diaphragm chamber 49, 49' formed between the diaphragm 44, 44' and the cover plate 48, 48'. As water under pressure is pumped into the chamber 49, 49' between the diaphragm 44, 44' and the cover plate 48, 48', the diaphragm 44, 44' elastically deflects and/or expands to at least partially conform to the shape of the diaphragm housing 42, 42'.

A nozzle valve 50 is located at the end of the discharge conduit 52, which is in communication with the diaphragm chambers 49, 49' formed between the covers 48, 48' and the diaphragms 44, 44'. The valve assembly 50 may be any type of valve, such as a rotating disk, ball or cylinder valve or any other type of valve which can be opened by actuating the trigger 16 so that water under pressure due to the expansion and deflection of the diaphragms 44, 44' is ejected through the nozzle 54. Preferably, a linkage 56 is connected between the trigger 16 and the valve assembly 50 such that actuation of the trigger 16 by squeezing opens the valve assembly 50. In the preferred embodiment, the trigger 16 has a tubular portion which slides along the outer body of the pump 26 which guides the trigger 16 for linear movement.

Figure 2:
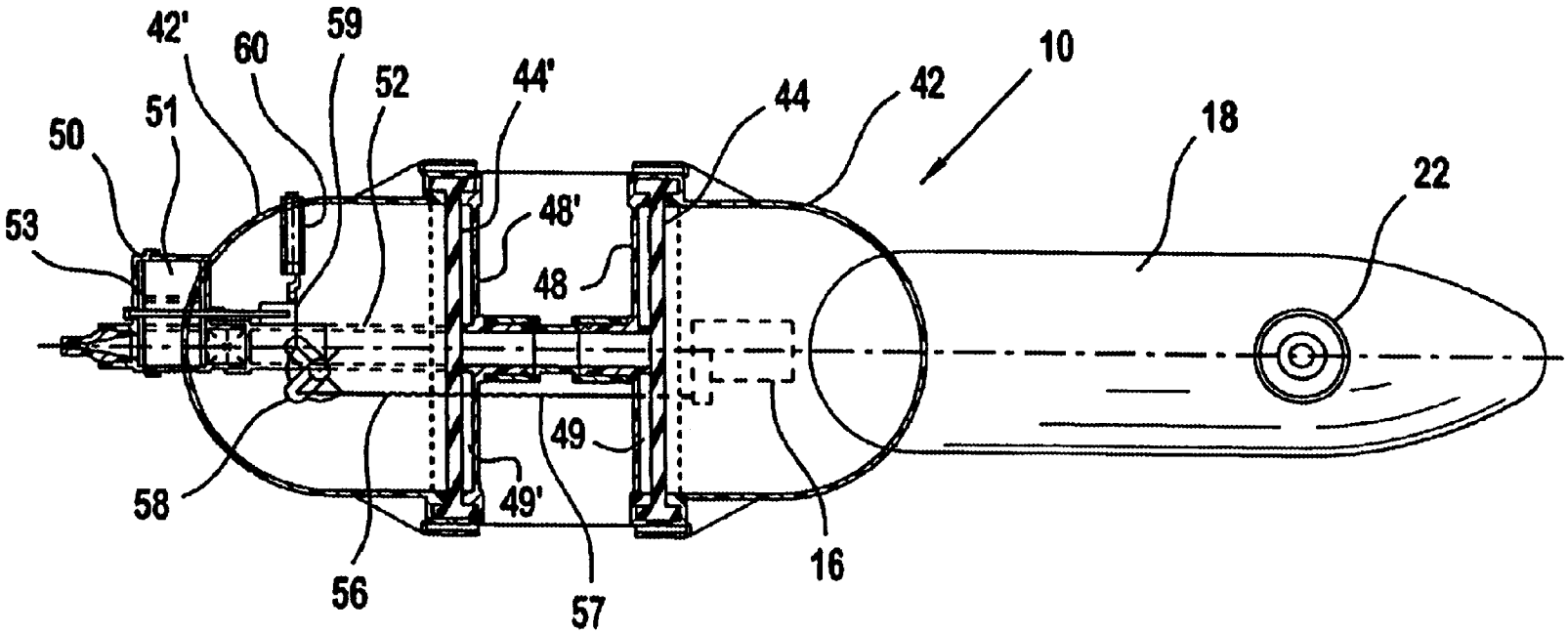
FIG. 2 is a top view, partially in cross-section, of the water gun shown in FIG. 1 in which the water supply tank, two diaphragm chambers and the release valve linkage are shown in detail.

Referring now to FIG. 2, the tank 18 with the cap 22 for the water gun 10 is shown. Also shown is a top view of the diaphragm housings 42, 42' with the diaphragms 44, 44' located between the cover 48, 48' and the housing 42, 42'. The trigger 16, located below the gun housing 12 and diaphragm housing 42 is shown in dashed lines along with the linkage 56 which consists of a first link 57 that extends between the trigger 16 and a first leg of a pivot arm 58. A second leg of the pivot arm is connected to a second link 59 that rotates the valve assembly 50 to an open position. The valve assembly 50 is shown as a disk valve having a rotating disk 51 with an opening 53 which can be moved into or out of alignment with the discharge conduit 52. A return spring 60 is used to bias the valve assembly 50 to a closed position. While one specific linkage and valve assembly have been shown, those skilled in the art will recognize that other valve assemblies and linkage arrangements can be utilized by the present invention.

Those skilled in the art will recognize that the shape of the housing 12 may be varied and that one or more diaphragm assemblies 40, 40' may be utilized in connection with the diaphragm water gun 10 in accordance with the present invention. Preferably the housing 12 and supply tank 18 along with the diaphragm housings 42, 42' are made of molded plastic.

Referring now to FIG. 3, a single diaphragm assembly 140 for use in a water gun in shown. The diaphragm assembly 140 includes the housing 142 and a diaphragm 144 which is clamped between the diaphragm cover 148 and the diaphragm housing 140 to form a pressurizable diaphragm chamber 149. Preferably, the diaphragm 144 includes an enlarged portion 146 along its circumferential periphery so that it can be clamped between the cover 148 and the housing 142. A water conduit 132 is shown that extends from a pump (not shown) in order to pressurize the diaphragm assembly 140 with water. A check valve 136 is located in the flow path to prevent water from returning back to the pump, and preferably includes a conical-shaped, spring loaded plug 137 that seats in an opening facing the pump. A release valve 170 is preferably also provided in order to prevent over-pressurization of the diaphragm assembly 140, and also includes a conical-shaped, spring loaded plug 171 that seats in an opening in the release conduit. A release conduit 152 is connected between an opening in the cover 148 and the nozzle (not shown). Pressurized water from the pump is pumped via a conduit 132 through the check valve 136 and through the opening in the cover 148 into the chamber 149 between the cover 148 and the diaphragm 144, causing the diaphragm 144 to expand under pressure to the position shown in phantom lines as 144' in FIG. 3. The check valve 136 prevents pressurized water from bleeding back through the conduit 132 toward the pump. If excess pressure is reached, the release valve 170 opens, releasing pressurized water from the diaphragm assembly 140. In order to release the water, the nozzle valve is opened, preferably in a similar manner to that discussed above, and the diaphragm 144 contracts back toward its neutral position expelling water through the release conduit 152 and the nozzle (not shown).

As shown in FIG. 4, the diaphragm 144 preferably has a circular shape and the cover 148 is bolted around its periphery to securely hold the diaphragm 144 in position between the cover 148 and the housing 142. Preferably, the enlarged edge portion 146 of the diaphragm 144 is clamped within a channel formed in the cover 148 and the diaphragm housing 142.

Referring now to FIG. 5, the size of the diaphragm housing 142' can be changed to provide a greater area for expansion of the diaphragm 144. The housing 142' may be formed from an extruded tube 143 with an end cap 145 located on the end opposite from the diaphragm 144. The diaphragm housing 42, 142, 142' serves to protect the diaphragm from outside damage and also serve to protect the user in the event that the diaphragm ruptures while it is under pressure. The diaphragm housing 42, 142 can be formed separately from the water gun housing 12 or can be formed integrally therewith.

The use of the diaphragm 44, 44', 144 allows for easier and cheaper formation of an elastic pressure holding and generating means to allow pressurized water to be stored in the water gun 10 in accordance with the invention. Due to its generally flat configuration, molding of a diaphragm is much simpler and less costly than molding of tubular bladders of the type known in the art. Additionally, the diaphragm 44, 44', 144 can be molded to have a thickness that varies radially in order to enhance the uniform expansion and contraction of the diaphragm. For example, the thickness could be decreased in the center in order to promote initial expansion in this area.

While the preferred embodiment of the invention has been described in detail, the invention is not limited to the specific embodiments described above, which should be considered as merely exemplary. Further modifications and extensions of the present invention may be developed, and all such modifications are deemed to be within the scope of the present invention as defined above and by the appended claims.

What is claimed is:

1. A diaphragm water gun, comprising:

a housing;

a supply tank connected to the housing;

a diaphragm assembly connected to the housing, including a generally planar diaphragm located between a cover and a diaphragm housing, said diaphragm housing having an open end, said diaphragm being secured at the open end such that in a relaxed position said generally planar diaphragm extends across the open end and remains generally outside said diaphragm housing, a diaphragm chamber being formed between the cover and the diaphragm;

a pump for drawing water from the supply tank and forcing the water into the diaphragm chamber so that said diaphragm expands into said diaphragm housing;

a release conduit in fluid communication between the diaphragm chamber and a release valve; and an actuator connected to the release valve for moving the release valve from a first state, in which the valve is closed, to a second state, in which the valve is open to discharge water from the water gun.

2. The diaphragm water gun of claim 1, further comprising a check valve located between the diaphragm chamber and the pump.

3. The diaphragm water gun of claim 1, further comprising a second diaphragm assembly connected to the housing, including a second diaphragm located between a second cover and a second diaphragm housing, with a second diaphragm chamber being located between the second cover and the second diaphragm, the pump being arranged to draw water from the supply tank and force the water into both of the diaphragm chambers.

4. The diaphragm water gun of claim 1, wherein the diaphragm includes an enlarged peripheral rim, and at least one of the cover and the diaphragm housing include a complementary shaped groove to receive the peripheral rim.

5. The diaphragm water gun of claim 4, wherein each of the cover and the diaphragm housing include a complementary shaped groove to receive the peripheral rim.

6. The diaphragm water gun of claim 1, further comprising an over-pressure release valve in fluid communication with the diaphragm chamber.

7. The diaphragm water gun of claim 1, wherein the release valve is a disk valve that is rotated from a first, closed position to a second, open position about an axis of rotation.

8. The diaphragm water gun of claim 1, wherein the cover is generally flat.

9. The diaphragm water gun of claim 1, wherein the diaphragm housing includes a generally hemispherical end.

10. The diaphragm water gun of claim 9, wherein the hemispherical end is connected to a cylindrical section that extends away from the cover.

11. The diaphragm water gun of claim 10, wherein the cylindrical section comprises a tube that is connected to a separate end piece.

12. The diaphragm water gun of claim 1, wherein the cover and the diaphragm housing are removably connected together.

13. The diaphragm water gun of claim 1, wherein the actuator comprises a trigger located on a handle extending from the housing.

14. The diaphragm water gun of claim 1, further comprising a nozzle located at an end of the release conduit.

* * * * *